US006290074B1

(12) United States Patent
Syvuk et al.

(10) Patent No.: US 6,290,074 B1
(45) Date of Patent: Sep. 18, 2001

(54) STORAGE AND DISPLAY RACK AND SHELF THEREFOR

(75) Inventors: Max Syvuk, Middleburg Heights; Stephen Hardy, Wadsworth, both of OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 09/576,509

(22) Filed: May 23, 2000

Related U.S. Application Data

(60) Provisional application No. 60/135,620, filed on May 24, 1999.

(51) Int. Cl.[7] ..... A47F 5/00

(52) U.S. Cl. ..... 211/74; 211/133.1; 211/188; 211/194; D7/619

(58) Field of Search ..... 211/74, 186, 188, 211/187, 133.1, 194; D7/619

(56) References Cited

U.S. PATENT DOCUMENTS

| | | | | |
|---|---|---|---|---|
| D. 256,346 | | 8/1980 | Annis . | |
| D. 329,963 | | 10/1992 | Schneider . | |
| D. 336,408 | * | 6/1993 | Tersch et al. | D7/619 |
| D. 385,080 | | 10/1997 | Schueneman et al. . | |
| 2,915,162 | | 12/1959 | Umstead . | |
| 3,372,812 | | 3/1968 | Parcels . | |
| 4,143,784 | * | 3/1979 | Frahm et al. . | |
| 4,431,107 | | 2/1984 | Bergstrom et al. . | |
| 4,520,941 | * | 6/1985 | Hagan et al. . | |
| 4,796,540 | | 1/1989 | Pelfrey . | |
| 4,801,025 | | 1/1989 | Flum et al. . | |
| 4,898,282 | | 2/1990 | Hawkinson et al. . | |
| 4,942,967 | | 7/1990 | Schneider . | |
| 4,953,719 | | 9/1990 | Spamer . | |
| 4,971,275 | * | 11/1990 | Roberts . | |
| 4,998,628 | | 3/1991 | Ross . | |
| 5,188,246 | | 2/1993 | Maxworthy . | |
| 5,244,272 | | 9/1993 | Thompson . | |
| 5,370,245 | | 12/1994 | Tersch et al. | 211/74 |
| 5,379,905 | | 1/1995 | Bustos et al. . | |
| 5,417,333 | | 5/1995 | Flum . | |
| 5,595,310 | | 1/1997 | Spamer et al. . | |
| 6,026,958 | * | 2/2000 | Kelly et al. . | |
| 6,079,339 | | 6/2000 | Houk, Jr. et al. . | |
| 6,135,297 | * | 10/2000 | DeShazo et al. | 211/74 |

* cited by examiner

*Primary Examiner*—Robert W. Gibson, Jr.
(74) *Attorney, Agent, or Firm*—Robert H. Resis; Banner & Witcoff, Ltd.

(57) ABSTRACT

A storage and display rack for supporting and displaying large substantially cylindrical objects, such as five gallon plastic water bottles. The storage and display rack is fabricated from one or more shelves, supported by a plurality of tubular legs. Where the storage and display rack includes more than one shelf, a plurality of tubular legs is employed to vertically separate and support successive levels of shelves. Each shelf is provided with one or more inclined slots for receiving a bottle. Each slot is provided with a back wall, having an inner resiliently support back wall member, and a plurality of ribs for raising the bottle above the bottom web of the slot. The resiliently supported back wall member is fabricated for resistance to fatigue failure. The ribs are provided to permit insertion and removal of the bottle(s) with reduced friction.

51 Claims, 7 Drawing Sheets

STORAGE AND DISPLAY RACK AND SHELF THEREFOR

This application claims benefit of Provisional No. 60/135,620 filed May 24, 1999.

BACKGROUND OF THE INVENTION

1. Field of the Invention

The present invention relates to modular storage and display racks, in particular, molded plastic modular storage and display racks for cylindrical items, like water bottles. In particular, the present invention is directed to an improved shelf structure for such modular storage and display racks.

2. The Prior Art

Modular storage and display racks are known in the art. A typical modular storage and display rack in the prior art includes one or more molded plastic shelves. Each shelf is provided typically with at least a plurality of sockets on its underside, for insertably receiving a corresponding plurality of post members, to provide legs for the shelf. The legs may be tubular plastic members, which may be solid, hollow, open-ended or closed-ended. For example, the legs typically may be hollow, cylindrical, open-ended members, configured to fit into corresponding cylindrical sockets.

The sockets, in turn, may have cylindrical side walls, and may further include centrally disposed truncated frusto-conical structures, so that the side walls of the leg ends become wedged frictionally between the cylindrical side walls of the sockets and the centrally disposed truncated frusto-conical structures. Alternatively, the sockets may have cylindrical side walls with inner diameters which are closely fitted to the outer diameters of the corresponding leg ends, for producing the desired friction fit, so that the leg ends are releasably retained in their corresponding sockets. As a still further alternative, the sockets may be provided with a slight conicity, for producing the desired friction fit, while facilitating insertion of the leg ends into the socket openings.

In order to enable a rack to be constructed from a plurality of stacked identical shelves, each such shelf is typically also provided with a plurality of corresponding sockets on its upper side, typically positioned directly above and concentrically aligned with the sockets on the underside of the shelf.

SUMMARY OF THE INVENTION

The present invention comprises, in part, a shelf apparatus for a storage and display rack for substantially cylindrical objects. The shelf apparatus preferably comprises a monolithically formed shelf member, having a longitudinal axis and a transverse axis. A longitudinally extending recess in the shelf member defines at least one substantially cylindrical object-receiving slot disposed in the shelf member. At least two longitudinally extending, inclined ribs are operably supported in the shelf member for vertically supporting a substantially cylindrical object above a transversely arcuate bottom surface of the at least one substantially cylindrical object receiving slot. A resiliently supported back wall member, operably extends substantially transversely to the at least two longitudinally extending, inclined ribs, for abutting a downwardly extending end of a substantially cylindrical object placed into the at least one substantially cylindrical object receiving slot. A plurality of support member receiving sockets are operably disposed in an underside surface of the shelf member.

Preferably, the resiliently supported back wall member is supported along a bottom peripheral region thereof by the at least two longitudinally extending, inclined ribs, and further supported along a top peripheral region by a transversely extending top surface region of the shelf member.

BEST MODE FOR CARRYING OUT THE INVENTION

Figure 1:
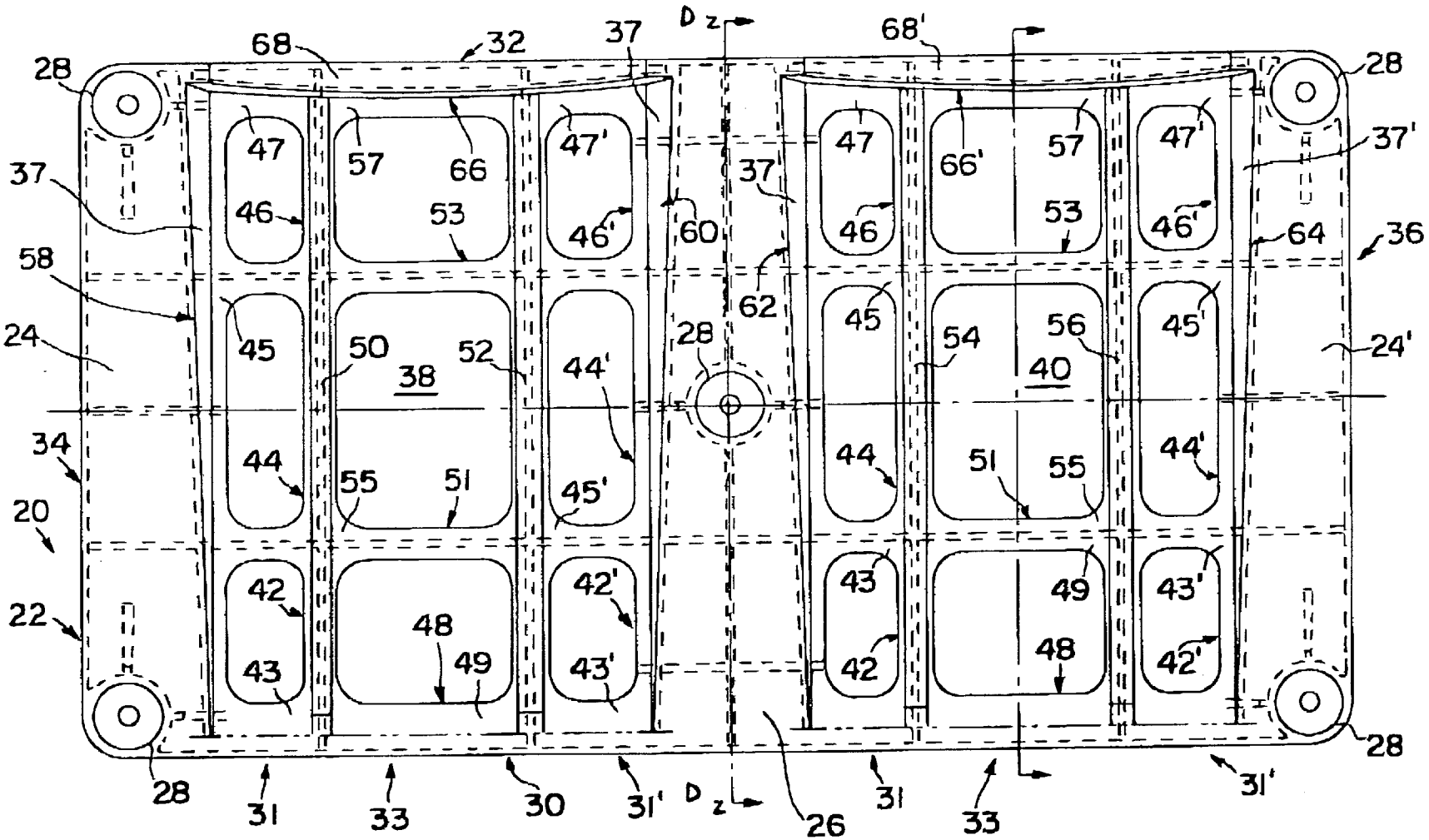
FIG. 1 is a top plan view of a shelf apparatus for use with the display and storage rack, according to a preferred embodiment of the invention.

While this invention is susceptible of embodiment in many different forms, there is shown in the drawings and will herein be described in detail, several embodiments, with the understanding that the present disclosure is to be considered as an exemplification of the principles of the invention and is not intended to limit the invention to the embodiments illustrated.

FIGS. 1–10 illustrate various views of the shelf 20 of the present invention. It is to be understood that according to conventional drafting principles, elements which are shown in broken/dotted lines, comprises structures which are "behind" the plane of the particular section or elevation shown.

Figure 10:
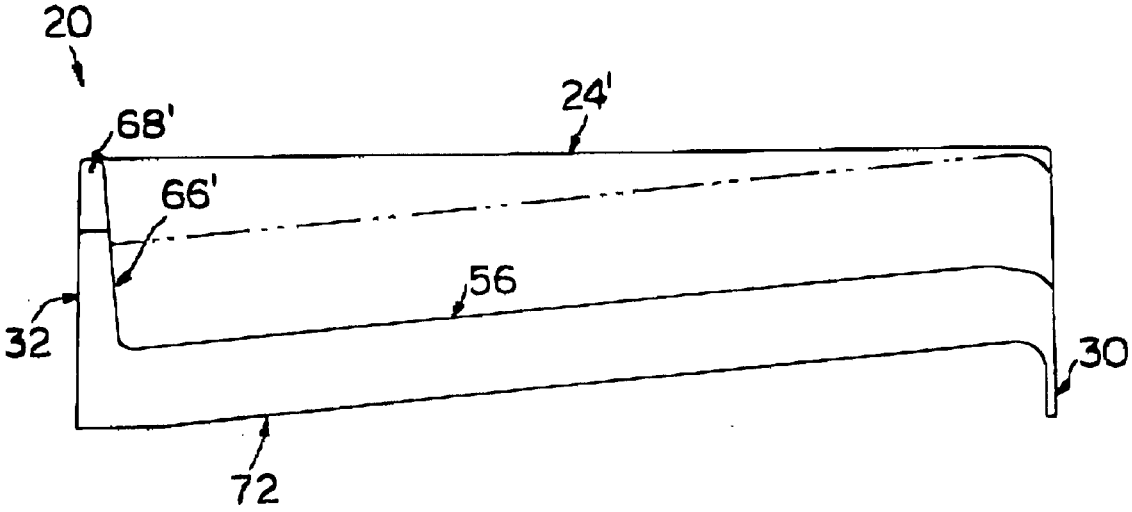
FIG. 10 is a side elevation, partially in section, of the shelf apparatus, taken along line X—X, of FIG. 2, looking toward side wall 36.
Figure 11:
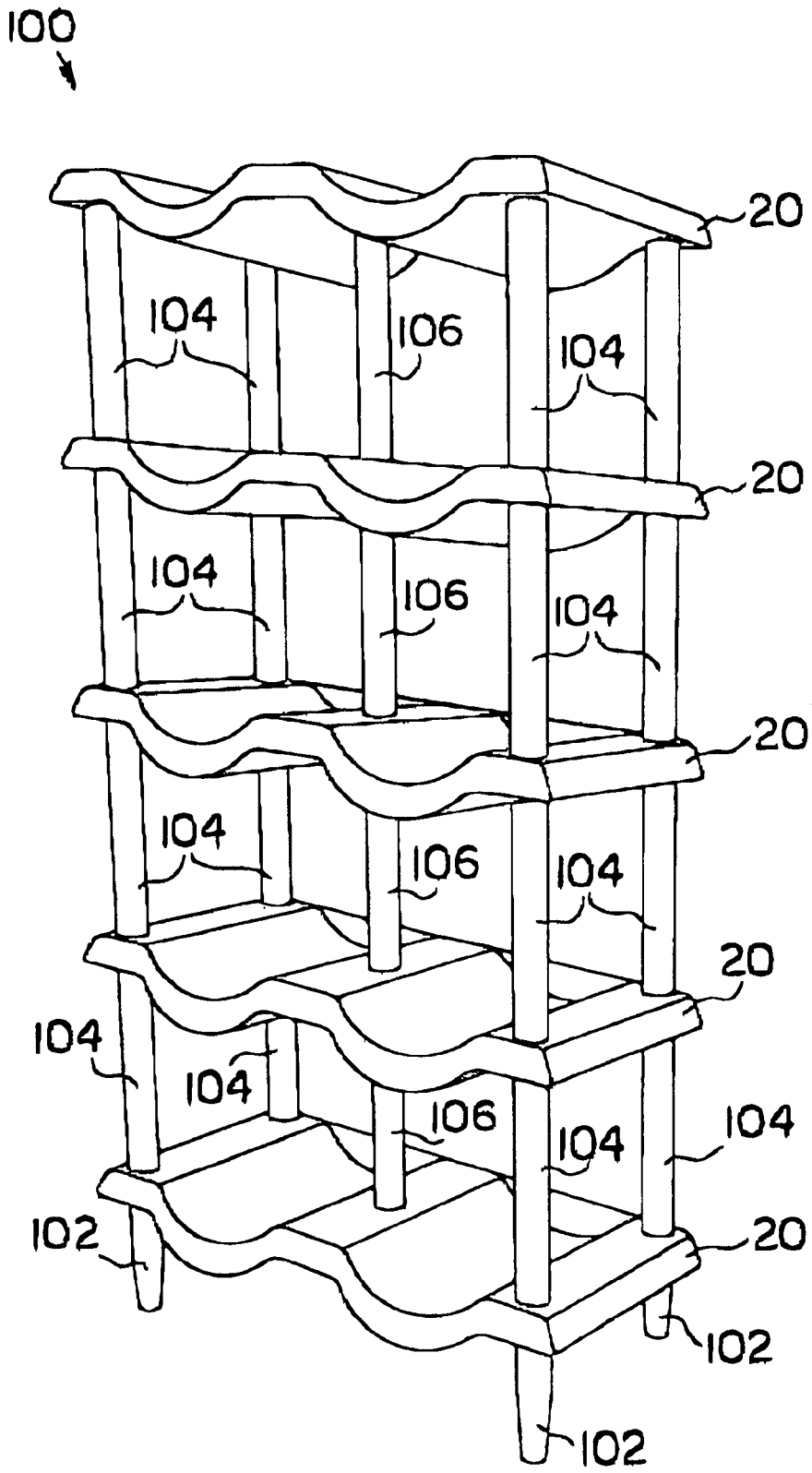
FIG. 11 is an isometric view of a modular storage and display rack, in which the shelf apparatus of the present invention may be employed.

FIG. 11 illustrates, in an isometric projection, a modular storage and display rack 100. Rack 100 incorporates a plurality of shelves 20. Shelves 20 are only generally illustrated in FIG. 11 and the details of the structure of shelves 20 of the present invention are shown in FIGS. 1–10, and described in the accompanying text. Each shelf 20 has a plurality of sockets 28, for insertably receiving the upper or lower ends of tubular legs 102, corner spacer tubes 104 and center spacer tubes 106.

FIG. 1 is a top plan view of shelf 20 of the present invention. Shelf 20 preferably is fabricated as a monolithically formed single unit, such as by injection molding or other suitable method.

Shelf 20 is preferably fabricated from an injection-moldable plastic material, preferably one that provides some degree of flexibility, while being capable, in the embodiment illustrated and described herein, for permitting five or six or more levels of shelves to be stacked and to bear the combined load of several hundred pounds of filled five-gallon water bottles. Shelf 20 includes encircling substantially rectangular side wall 22, side upper surfaces 24, and central upper surface 26. Sockets 28 preferably are provided at the corners of shelf 20 and at the center of shelf 20, as defined by axis D (line Z—Z of FIG. 1) and axis W. Shelf 20 includes descending front wall 30, outer back wall 32 and side walls 34 and 36.

In a preferred embodiment of the invention, shelf 20 is provided with two bottle slots 38 and 40, for receiving and retaining substantially cylindrical water bottles (not shown). Each bottle slot 38, 40 comprises an arcuately depressed region of shelf 20. In order for the bottles (not shown) to be securely received in bottle slots 38, 40, bottle slots 38, 40 are inclined downwardly from front wall 30 toward back wall 32. Preferably, each slot 38, 40 has a generally curved inner surface, apart from the ribs 50, 52, 54 and 56, as described in further detail hereinafter.

Figure 4:
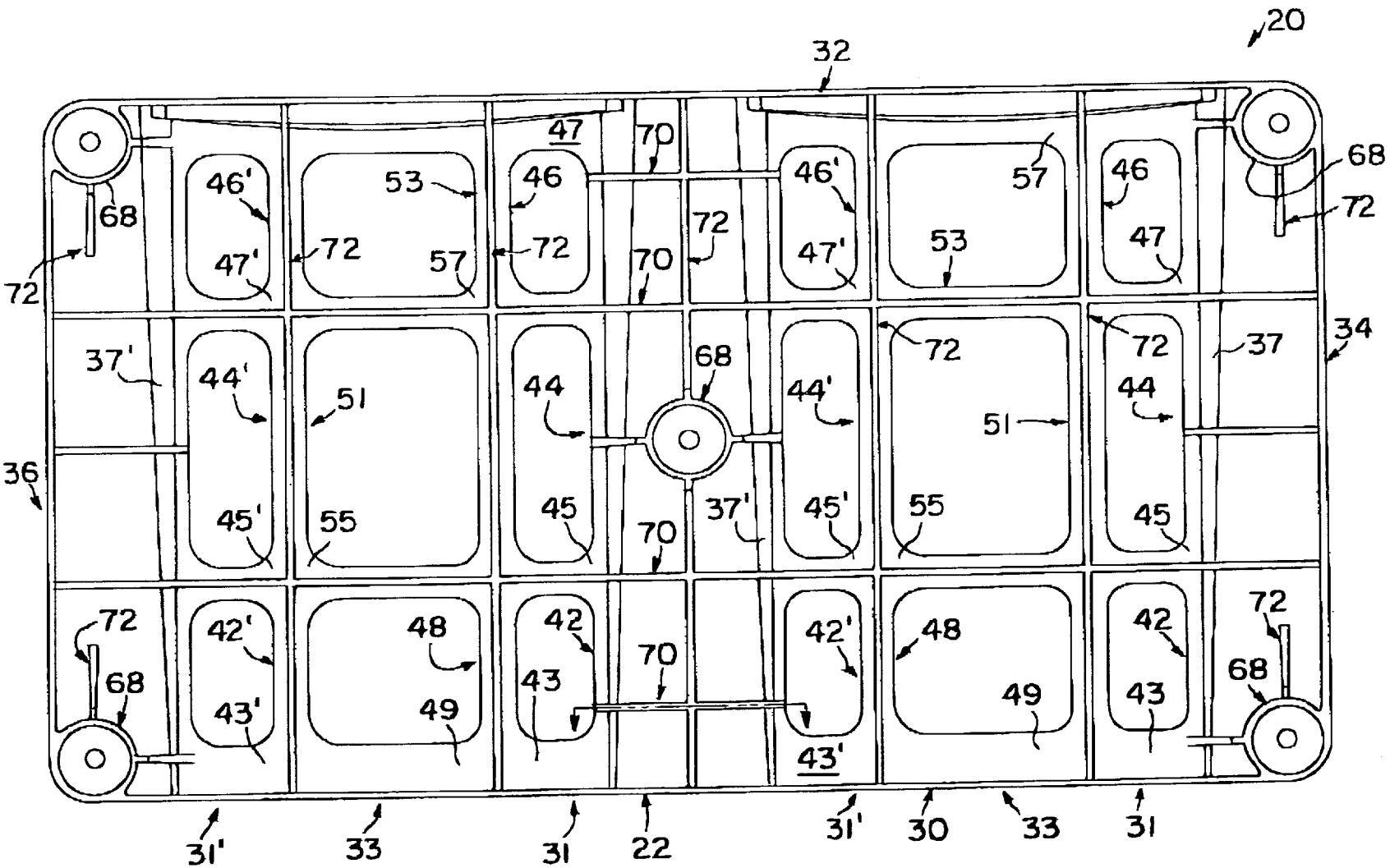
FIG. 4 is a bottom elevation of the shelf apparatus of FIGS. 1–3.

In order to reduce the quantity of plastic material required for each self 20, apertures 42, 42', 44, 44', 46, 46', 48, 51 and 53 are provided in shelf 20, specifically in bottle slots 38 and 40. In addition, apertures 42, 42'44, 44', 46, 46', 48, 51 and 53 help to drain water which may be dropped from the bottles, which may come from leaking bottles, condensation, residual water from cleaning the bottles, etc. Apertures 42, 42', 44, 44', 46, 46', 48, 51 and 53 are defined by surrounding webs 43, 43', 45, 45', 47, 47', 49, 55 and 57, which in turn, are supported by an array of vertically extending transversely extending ribs 70 and longitudinally extending ribs 72 (FIG. 4).

Webs 43, 45, 47 of each slot define longitudinally extending narrow panels 31. Webs 43', 45'and 47' define longitudinally extending narrow panels 31'. Panels 31, 31' flank central panels 33. Each of panels 31, 31' and 33 appears substantially rectangular in plan view in FIG. 1, but can be recognized from FIGS. 2, 5 and 6, to be curved concavely upward across their respective widths, and inclined downwardly from the front wall 30 of shelf 20, to slot back wall 66. Each slot back wall 66 curves convexly forward, when viewed from above in FIG. 1. Wedge-shaped panels 37, 37', which also have convexly curved upper surfaces, extend along the upper side edges of panels 31, 31', respectively.

Ribs 50, 52, 54 and 56 emanate upwardly from the adjacent webs defining panels 31, 31' and 33, to support the bottles above the concavely curved upper surfaces of bottle slots 38, 40. Ribs 50, 52, 54 and 56 preferably are triangular in cross-section so that the upper crests of each rib support the bottles received in each of slots 38, 40, above the arcuate surfaces of slots 38, 40.

By providing a relatively small surface area (the crests of the ribs) for supporting the bottles, there is less surface area for creating frictional resistance to sliding the heavy bottles into and out of the slots thus making it easier to remove a bottle from the shelf 20.

The upper edges 58, 60, 62 and 64 of slots 38, 40 (the top edges of panels 37, 37') adjoin top surfaces 24, 24', and center top surface 26, and diverge from front to back, as shown in FIG. 1. Because slots 38, 40 are generally cylindrical in configuration, and are downwardly inclined from front to back, the back ends of slots 38, 40 extend transversely through a greater arc length than do the front ends of slots 38, 40.

Figure 2:
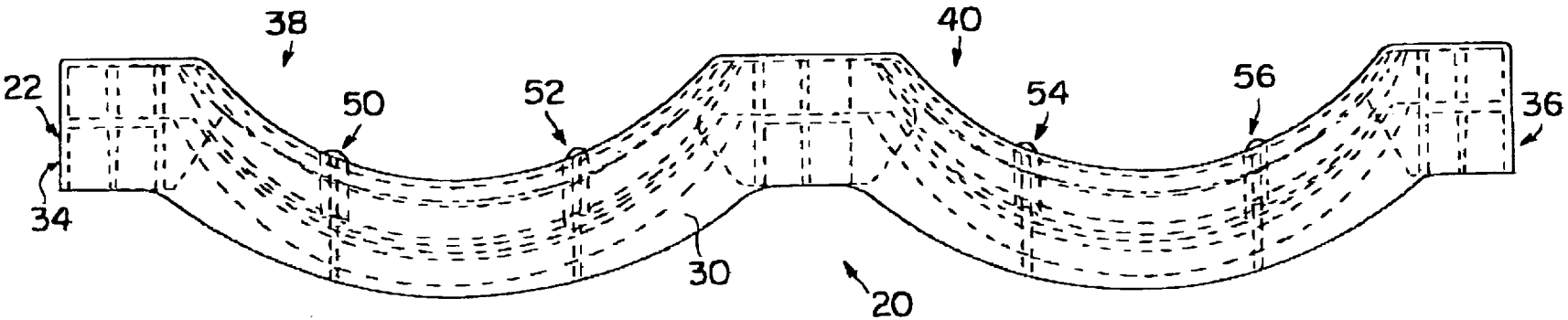
FIG. 2 is a front elevation of the shelf apparatus of FIG. 1.
Figure 3:
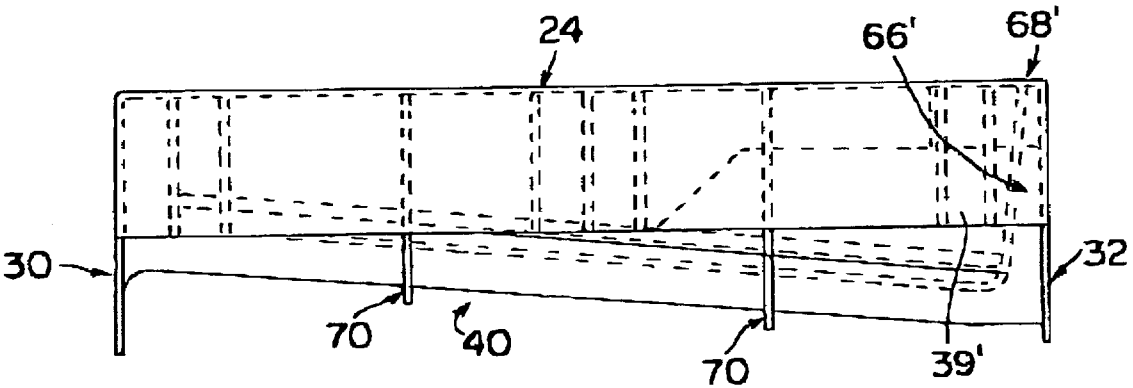
FIG. 3 is a left side elevation of the shelf apparatus of FIGS. 1 and 2.

FIG. 3 is a side elevation of shelf 20, according to the embodiment of FIGS. 1 and 2. FIG. 3 illustrates the inclined orientation of slots 38, 40, in particular the configuration of slot 40 which is directly visible from the perspective of FIG. 3. The back ends 39, 39' of slots 38, 40 terminate in vertically inclined back walls 66, 66'. Walls 66, 66' are supported from top ledges 68, 68', and emanate upwardly from the rear edges of webs 47, 57 and 47' of each of slots 38 and 40. Support for each of back walls 66, 66' is also provided by ribs 50, 52, 54 and 56. For example, when a bottle is inserted into slot 40, down ribs 54, 56, the bottom of the bottle contacts back wall 66', which is inclined to the vertical, and also substantially perpendicular to the bottom of slot 40. This orientation, in combination with the convexly curved face of back wall 66', means that a greater amount of surface area of wall 66', spread over its width and height, will make contact with the bottle bottom. The impact of the bottle is thereby less concentrated than that which may occur in prior art constructions. In addition, because back wall 66' is supported at both the top and bottom edges thereof, there is no tendency for the wall to be pivoted around a single bottom edge, as in a prior art shelf structure having a single thickness rear wall construction. This support at top and bottom of back wall 66', in combination with the limited flexibility of the shelf material, provides "give" for absorbing and dispersing the impact of the bottle, and enhances the resistance of the shelf to degradation and failure resulting from material fatigue. In addition, because the bottom of the slot and the back wall are more "square" to one another and to the bottom of a bottle received in the slot, there is reduced tendency for the bottle to ride up and over the slot back wall.

FIG. 4 is a bottom plan view of shelf 20. Sockets 68 are provided to receive the upper ends of cylindrical tubes (not shown) which may be the upper ends of legs (if the shelf is the bottom or only shelf), or of spacing pylons (for spacing shelves). To provide rigidity to shelf 20, transverse ribs 70 and longitudinal ribs 72 are provided.

Figure 5:
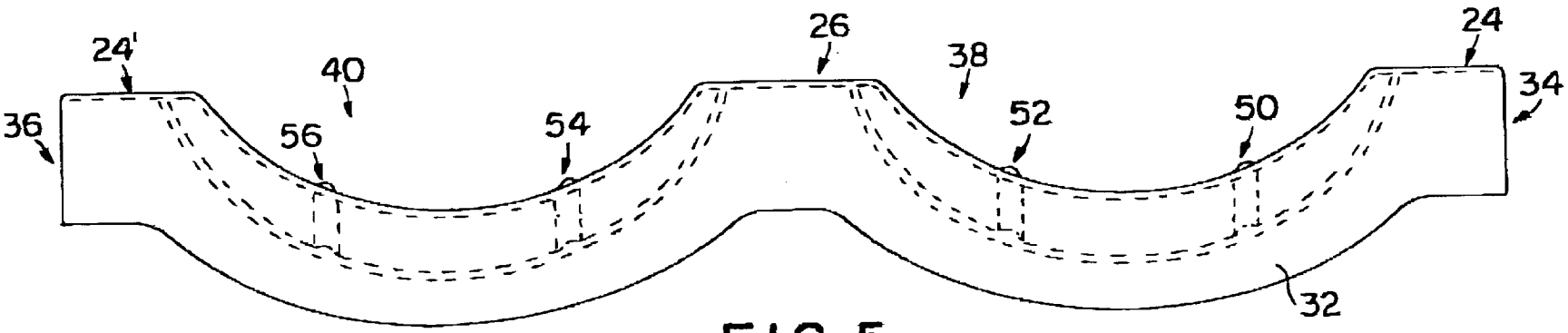
FIG. 5 is a rear elevation of the shelf apparatus of FIG. 1–4.

FIG. 5 is a rear elevation of shelf 20, in which the front ends of ribs 50, 52, 54 and 56 are shown extending above the top surface 68 adjacent back wall 32. The ribs are shown in broken lines descending while extending from the front wall of shelf 20, toward the slot back walls.

Figure 6:
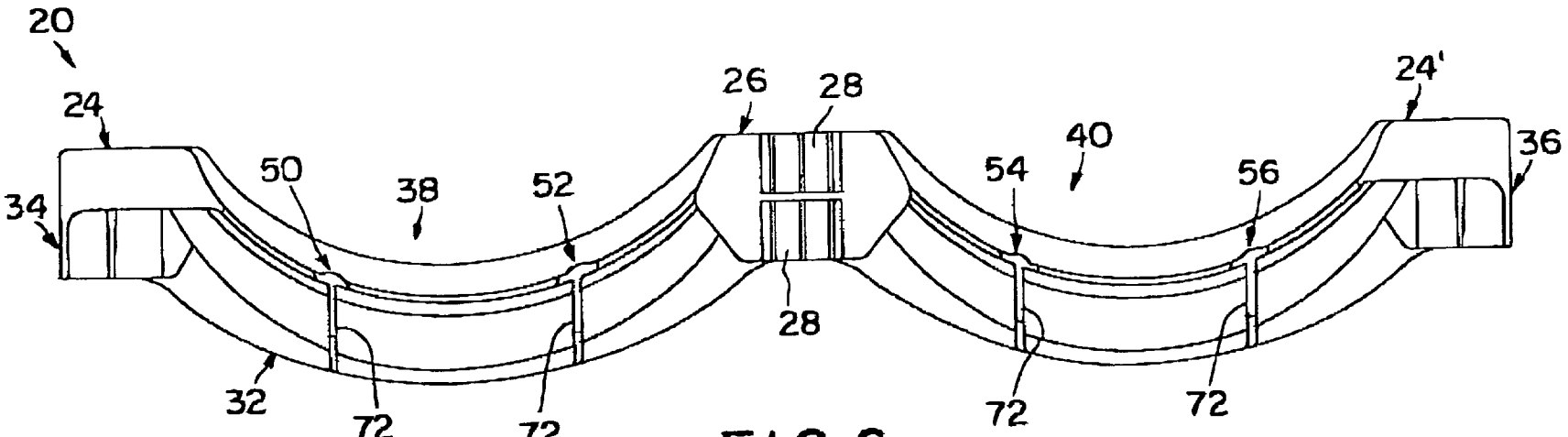
FIG. 6 is an elevation, partially in section, of the shelf apparatus of FIGS. 1–5, taken along the transverse axis W of FIG. 1, and looking toward the rear wall 32.

FIG. 6 is an elevation, partially in section, of the shelf apparatus of FIGS. 1–5, taken along the transverse axis W of FIG. 1, and looking toward the rear wall 32, and illustrating, in particular, the centered upper and lower sockets 28.

Figure 8:
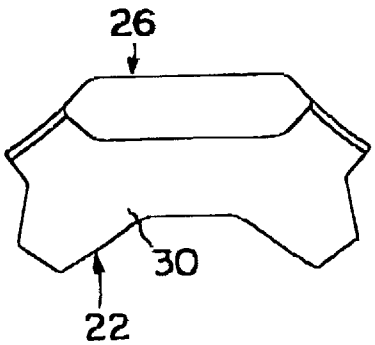
FIG. 8 is an elevation, partially in section, of the shelf apparatus, taken along line S—S, of FIG. 4, looking toward front wall 30.
Figure 7:
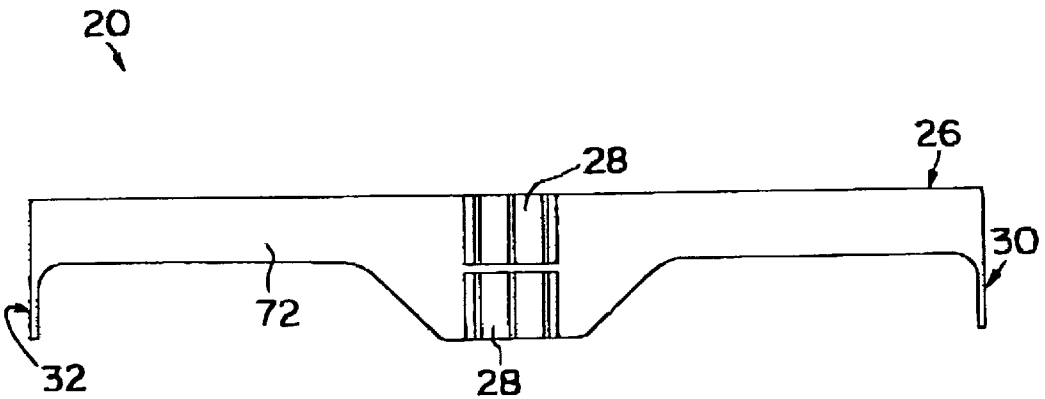
FIG. 7 is an elevation, in section, of the shelf apparatus of FIGS. 1–6, taken along the longitudinal axis D (line Z—Z) of FIG. 1.

FIG. 7 is an elevation, in section, of the shelf apparatus of FIGS. 1–6, taken along the longitudinal axis D (line Z—Z) of FIG. 1. Rib 72 extends along the length of shelf 20, interrupted only by the material of underside central socket 28. FIG. 8 is an elevation, partially in section, of the shelf apparatus, taken along line S—S, of FIG. 4, looking toward front wall 30.

Figure 9:
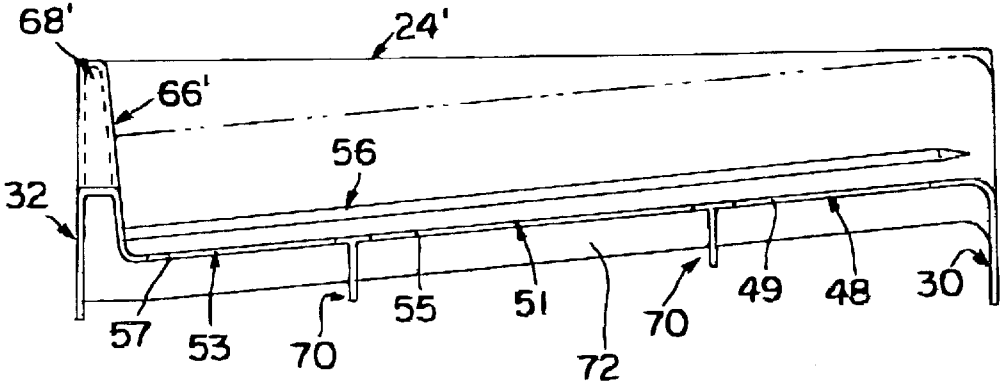
FIG. 9 is a side elevation, partially in section, of the shelf apparatus, taken along line Y—Y, of FIG. 1, looking toward side wall 36.

FIG. 9 is a side elevation, partially in section, of the shelf apparatus, taken along line Y—Y, of FIG. 1, looking toward side wall 36. FIG. 9 is a section taken at the bottom of slot 40, along the longitudinally extending center of panel 33 of slot 40.

FIG. 10 is a side elevation, partially in section, of the shelf apparatus, taken along line X—X, of FIG. 2, looking toward side wall 36. FIG. 10, in particular, is a sectional view taken in a plane extending through rib 56.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A shelf apparatus for a storage and display rack for substantially cylindrical objects, comprising:

a monolithically formed shelf member, having a longitudinal axis and a transverse axis;

at least one substantially cylindrical object-receiving slot disposed in the shelf member, defined by a longitudinally extending recess in the shelf member, at least two longitudinally extending, inclined ribs, operably supported in the shelf member for vertically supporting a substantially cylindrical object above a transversely arcuate bottom surface of the at least one substantially cylindrical object receiving slot, and a resiliently supported back wall member, operably extending substantially transversely to the at least two longitudinally extending, inclined ribs, for abutting a downwardly extending end of a substantially cylindrical object placed into the at least one substantially cylindrical object receiving slot; and a plurality of support member receiving sockets operably disposed in an underside surface of the shelf member.

2. The shelf apparatus according to claim 1, wherein the resiliently supported back wall member is supported along a bottom peripheral region thereof by the at least two longitudinally extending, inclined ribs, and further supported along a top peripheral region by a transversely extending top surface region of the shelf member.

3. A shelf apparatus for a storage and display rack for substantially cylindrical objects, comprising:

a monolithically formed shelf member, having a longitudinal axis and a transverse axis;

at least one substantially cylindrical object receiving slot disposed in the shelf member, defined by a longitudinally extending recess in the shelf member, at least two longitudinally extending, inclined rids, operably supported in the shelf member for vertically supporting a substantially cylindrical object above a transversely arcuate bottom surface of the least one substantially cylindrical object receiving slot, and a resiliently supported back wall member operably extending substantially transverely to the longitudinally extending recess for abutting an end of a substantially cylindrical object placed into the at least one substantially cylindrical object receiving slot.

4. A shelf apparatus for a storage and display rack for substantially cylindrical objects, comprising:

a monolithically formed shelf member, having a longitudinal axis and a transverse axis;

at least one substantially cylindrical object-receiving slot disposed in the shelf member, defined by a longitudinally extending recess in the shelf member, and at least two longitudinally extending, inclined ribs, operably supported in the shelf member for vertically supporting a substantially cylindrical object above a transversely arcuate bottom surface of the at least one substantially cylindrical object receiving slot;

a back wall member; and a plurality of support member receiving sockets operably disposed in an underside surface of the shelf member.

5. A shelf apparatus for a storage and display rack for substantially cylindrical objects, comprising:

a monolithically formed shelf member, having a longitudinal axis and a transverse axis;

at least two longitudinally extending, inclined ribs, operably supported in the shelf member for vertically supporting a substantially cylindrical object above a transversely arcuate bottom surface of the at least one substantially cylindrical object receiving slot, at least one object receiving slot disposed in the shelf member defined by a longitudinally extending recess in the shelf member, said recess having a curved cross-section corresponding to the curved surface of the cylindrical object so as to securely hold cylindrical objects on the shelf.

6. The shelf apparatus of claim 3, wherein the inclined ribs are substantially parallel.

7. The shelf apparatus of claim 3 wherein the shelf member defines at least one aperture to reduce the quantity of material to form the shelf member.

8. The shelf apparatus of claim 3, wherein the shelf member is made from injection-moldable plastic material.

9. The shelf apparatus of claim 3, wherein the shelf member defines at least one the aperture between the inclined ribs.

10. The shelf apparatus of claim 3, wherein the shelf member has a plurality of surrounding webs that define a plurality of apertures.

11. The shelf apparatus of claim 10, wherein the surrounding webs are supported by an array of vertically extending ribs, the vertically extending ribs located on an underside surface of the shelf member, wherein some vertically extending ribs extend transversely and some vertically extending ribs extend longitudinally along the underside surface of the shelf member.

12. The shelf apparatus of claim 3, wherein the inclined ribs are inclined downwardly towards the back wall member.

13. The shelf apparatus of claim 3, wherein at least two shelf members are joined side by side.

14. The shelf apparatus of claim 5, wherein the inclined ribs are substantially parallel.

15. The shelf apparatus of claim 5 wherein the shelf member defines at least one aperture to reduce the quantity of material to form the shelf member.

16. The shelf apparatus of claim 5, wherein the shelf member is made from injection-moldable plastic material.

17. The shelf apparatus of claim 5, wherein the shelf member defines at least one the aperture between the inclined ribs.

18. The shelf apparatus of claim 5, wherein the shelf member has a plurality of surrounding webs that define a plurality of apertures.

19. The shelf apparatus of claim 18, wherein the surrounding webs are supported by an array of vertically extending ribs, the vertically extending ribs located on an underside surface of the shelf member, wherein some vertically extending ribs extend transversely and some vertically extending ribs extend longitudinally along the underside surface of the shelf member.

20. The shelf apparatus of claim 5, wherein the inclined ribs are inclined downwardly towards the back wall member.

21. The shelf apparatus of claim 5, wherein at least two shelf members are joined side by side.

22. The shelf apparatus of claim 1, wherein the inclined ribs are substantially parallel.

23. The shelf apparatus of claim 1 wherein the shelf member defines at least one aperture to reduce the quantity of material to form the shelf member.

24. The shelf apparatus of claim 1, wherein the shelf member is made from injection-moldable plastic material.

25. The shelf apparatus of claim 1, wherein the shelf member defines at least one the aperture between the inclined ribs.

26. The shelf apparatus of claim 1, wherein the shelf member has a plurality of surrounding webs that define a plurality of apertures.

27. The shelf apparatus of claim 26, wherein the surrounding webs are supported by an array of vertically extending ribs, the vertically extending ribs located on an underside surface of the shelf member, wherein some vertically extending ribs extend transversely and some vertically extending ribs extend longitudinally along the underside surface of the shelf member.

28. The shelf apparatus of claim 1, wherein the inclined ribs are inclined downwardly towards the back wall member.

29. The shelf apparatus of claim 1, wherein at least two shelf members are joined side by side.

30. The shelf apparatus of claim 4, wherein the inclined ribs are substantially parallel.

31. The shelf apparatus of claim 4 wherein the shelf member defines at least one aperture to reduce the quantity of material to form the shelf member.

32. The shelf apparatus of claim 4, wherein the shelf member is made from injection-moldable plastic material.

33. The shelf apparatus of claim 4, wherein the shelf member defines at least one the aperture between the inclined ribs.

34. The shelf apparatus of claim 4, wherein the shelf member has a plurality of surrounding webs that define a plurality of apertures.

35. The shelf apparatus of claim 34, wherein the surrounding webs are supported by an array of vertically extending ribs, the vertically extending ribs located on an underside surface of the shelf member, wherein some vertically extending ribs extend transversely and some vertically extending ribs extend longitudinally along the underside surface of the shelf member.

36. The shelf apparatus of claim 4, wherein the inclined ribs are inclined downwardly towards the back wall member.

37. The shelf apparatus of claim 4, wherein at least two shelf members are joined parallel to each other.

38. The shelf apparatus of claim 1, further comprising at least a first shelf member and a second shelf member, wherein at least the first shelf member has a plurality of support member receiving sockets operably disposed in a topside surface thereof, and a plurality of support members capable of being inserted into the support member receiving sockets operably disposed in the topside surface of the first shelf member and inserted into the support member receiving sockets operably disposed in the underside surface of the second shelf member.

39. The shelf apparatus of claim 38, comprising a plurality of stacked shelf members to bear the combined load of a plurality of cylindrical objects.

40. The shelf apparatus of claim 2, further comprising at least a first shelf member and a second shelf member, wherein at least the first shelf member has a plurality of support member receiving sockets operably disposed in a topside surface thereof, and a plurality of support members capable of being inserted into the support member receiving sockets operably disposed in the topside surface of the first shelf member and inserted into the support member receiving sockets operably disposed in the underside surface of the second shelf member.

41. The shelf apparatus of claim 40, comprising a plurality of stacked shelf members to bear the combined load of a plurality of cylindrical objects.

42. The shelf apparatus of claim 4, further comprising at least a first shelf member and a second shelf member, wherein at least the first shelf member has a plurality of support member receiving sockets operably disposed in a topside surface thereof, and a plurality of support members capable of being inserted into the support member receiving sockets operably disposed in the topside surface of the first shelf member and inserted into the support member receiving sockets operably disposed in the underside surface of the second shelf member.

43. The shelf apparatus of claim 42, comprising a plurality of stacked shelf members to bear the combined load of a plurality of cylindrical objects.

44. The shelf apparatus of claim 3, wherein the shelf member further comprises a pair of longitudinally extending wedge shape, curved panels that face each other on a topside surface of the shelf member to further define the object receiving slot, wherein the wedge shape, curved panels diverge from each other as they extend towards the back wall member.

45. The shelf apparatus of claim 5, wherein the shelf member further comprises a pair of longitudinally extending wedge shape, curved panels that face each other on a topside surface of the shelf member to further define the object receiving slot, wherein the wedge shape, curved panels diverge from each other as they extend towards the back wall member.

46. The shelf apparatus of claim 1, wherein the shelf member further comprises a pair of longitudinally extending wedge shape, curved panels that face each other on a topside surface of the shelf member to further define the object receiving slot, wherein the wedge shape, curved panels diverge from each other as they extend towards the back wall member.

47. The shelf apparatus of claim 4, wherein the shelf member further comprises a pair of longitudinally extending wedge shape, curved panels that face each other on a topside surface of the shelf member to further define the object receiving slot, wherein the wedge shape, curved panels diverge from each other as they extend towards the back wall member.

48. The shelf apparatus of claim 3, wherein the shelf member further comprises at least one vertically extending transverse web and at least one vertically extending longitudinal web on the underside of the shelf member to provide rigidity to the shelf member.

49. The shelf apparatus of claim 5, wherein the shelf member further comprises at least one vertically extending transverse web and at least one vertically extending longitudinal web on the underside of the shelf member to provide rigidity to the shelf member.

50. The shelf apparatus of claim 1, wherein the shelf member further comprises at least one vertically extending transverse web and at least one vertically extending longitudinal web on the underside of the shelf member to provide rigidity to the shelf member.

51. The shelf apparatus of claim 4, wherein the shelf member further comprises at least one vertically extending transverse web and at least one vertically extending longitudinal web on the underside of the shelf member to provide rigidity to the shelf member.

* * * * *